US005772266A

United States Patent [19]

Skiba

[11] Patent Number: 5,772,266

[45] Date of Patent: Jun. 30, 1998

[54] DOOR SECURITY KIT

[76] Inventor: Wayne Skiba, 222 105th Ave. N.W., Coon Rapids, Minn. 55448

[21] Appl. No.: 738,189

[22] Filed: Oct. 28, 1996

[51] Int. Cl.[6] ..... E05C 19/18

[52] U.S. Cl. ..... 292/259 R

[58] Field of Search ..... 292/259 R, 258, 292/DIG. 53, 289

[56] References Cited

U.S. PATENT DOCUMENTS

| | | | |
|---|---|---|---|
| 313,942 | 3/1885 | Knauer . | |
| 910,283 | 1/1909 | Gerst . | |
| 2,130,216 | 9/1938 | Zaninovich . | |
| 2,163,206 | 6/1939 | Lopez | 292/259 R |
| 3,592,497 | 7/1971 | Logan, Jr. | 292/259 R |
| 3,806,179 | 4/1974 | Roessle | 292/259 R |
| 3,809,417 | 5/1974 | Craig | 292/259 R |
| 3,821,884 | 7/1974 | Walsh . | |
| 3,955,841 | 5/1976 | Walker . | |
| 3,980,330 | 9/1976 | Walker . | |
| 3,986,741 | 10/1976 | Giovannini | 292/259 R |
| 4,067,598 | 1/1978 | Mansour | 292/259 R |
| 4,667,992 | 5/1987 | Roden, Jr. | 292/259 R X |
| 5,447,046 | 9/1995 | Duffus . | |
| 5,452,929 | 9/1995 | Anderson . | |

*Primary Examiner*—Rodney M. Lindsey
*Attorney, Agent, or Firm*—Jacobson & Johnson

[57] ABSTRACT

A door security kit including a decorative covering for decoratively covering a door bar, the door bar made from a rigid member and having an exterior surface and a first end and a second end with the door bar having sufficient length so as to extend beyond the width of a door to enable the door bar to be secured on opposite sides of the door, the door bar having a first hole extending through one end of the door bar and a second hole extending through the opposite end of the door bar, a hinge pin attachment member having a first end for securing to a hinge pin on a door frame, the hinge pin attachment member having a second end for extending through the first hole in the door bar, a first fastener for securing to the second end of the hinge pin attachment member to hold the door bar in a rotatable condition on the hinge pin attachment member, a frame attachment member having a first end for securing to a door frame and a second end for extending through the second hole in the door bar sufficiently far so as to form a securable end thereon, and a second fastener for temporarily securing to the securable end to hold the door bar on the frame attachment member so that when the hinge pin attachment member and the frame attachment member are secured, the door bar prevents the door from being opened.

12 Claims, 2 Drawing Sheets

DOOR SECURITY KIT

FIELD OF THE INVENTION

This invention relates generally to security devices and more specifically to a security kit to enable a home owner to easily install the security kit to a door frame and hinge pin to simultaneously provide an esthetically pleasing appearance while preventing the door from being opened.

BACKGROUND OF THE INVENTION

Security devices to prevent entry or provide additional security are well known in the art. The present invention provides a security kit that can be quickly installed and secured to a door frame and a hinge pin with a minimum of effort, yet prevents the door from being forcibly opened. One of the disadvantages of door securing devices is that they do not match the decor of the room, and consequently there is a tendency not to install a security device. The present invention recognizes and overcomes the reluctance to install a security device by providing a security kit wherein the user can decorate with materials that allow the door bar to appear as if it were part of the normal structure of the building, thus addressing the often unvoiced esthetic concerns of a building resident.

BRIEF DESCRIPTION OF THE PRIOR ART

U.S. Pat. No. 910,283 shows a closing device for a door where a wing nut is used to hold a member on the shaft of another threaded member.

U.S. Pat. No. 3,955,841 shows a safety bar to hold a door in a closed or a partially open position.

U.S. Pat. No. 3,821,884 discloses a sliding door lock mechanism with a bar having an extendible bolt forming an engagement with a catch plate.

U.S. Pat. No. 5,452,929 discloses a keyless door lock wherein a bar has a key hole shape for quick attachment of anchors thereto.

U.S. Pat. No. 5,447,046 discloses a security bar for securing a door, with the security bar including a key lock.

U.S. Pat. No. 3,980,330 discloses a safety latch with a bar having one end for extending through the hinge knuckles and the other end for engaging a plate.

U.S. Pat. No. 3,986,741 discloses a security apparatus for a door with an eyelet for extending a hinge pin through and a bolt on the opposite end for engaging a keeper mechanism.

U.S. Pat. No. 3,806,179 discloses a bar lock for a door that includes a hinge to permit folding of the door lock.

U.S. Pat. No. 2,130, 216 discloses a door locking bar with a pin on one end and a slot on the other end for engaging an eye on a frame.

U.S. Pat. No. 313,942 discloses a bar for securing a double door with holding brackets for supporting the bar and preventing lateral movement of the bar.

SUMMARY OF THE INVENTION

A security kit for attachment to a hinge and a door frame with the security kit including a door bar, a door bar holder and a hinge pin attachment member that can be attached to a door hinge to allows the door bar to swing from an in-use position across the door to an out of the way position with the door bar being temporarily securable to an extension secured to a door frame by a threaded fastener or the like. The door bar includes an exterior surface for wrapping a decorative covering thereon so that the door bar can blend in with the door and door frame.

DESCRIPTION OF THE PREFERRED EMBODIMENT

Figure 1:
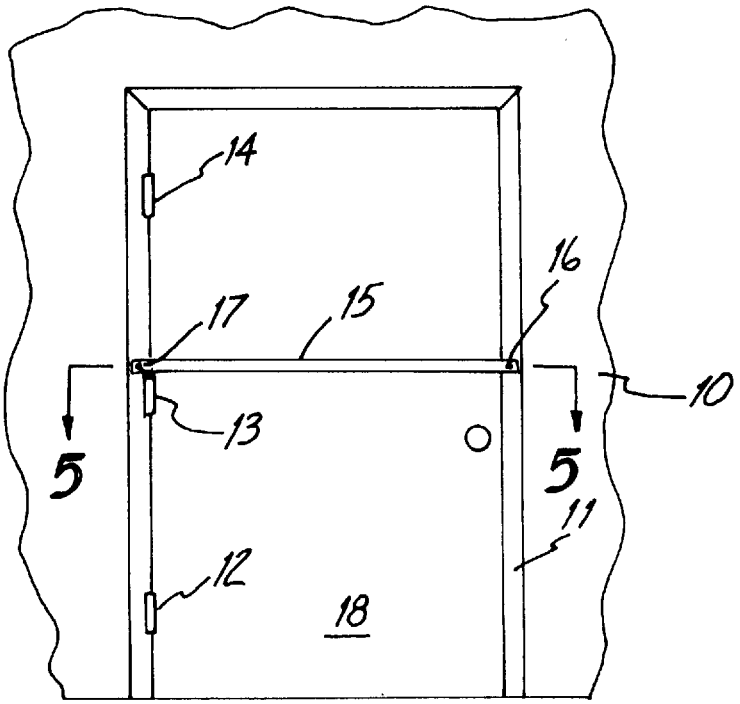
FIG. 1 shows a door with the door bar located in the secured position.

FIG. 1 shows a front view of a portion of a wall 10 with a hinged door 18 located in a frame 11. Frame 11 extends around the sides and top of door 18. Connecting door 18 to frame 11 is a first hinge 14, a second hinge 13 and a third hinge 12. Door 18 is normally swingable between an open position and a closed position. FIG. 1 shows a door bar 15 comprising a rigid member extending across the door to prevent the door from being opened. One end of door bar 15 is pivotally attached to a hinge attachment member 17 and the other end is temporarily securable to a frame attachment member 16.

Figure 2:
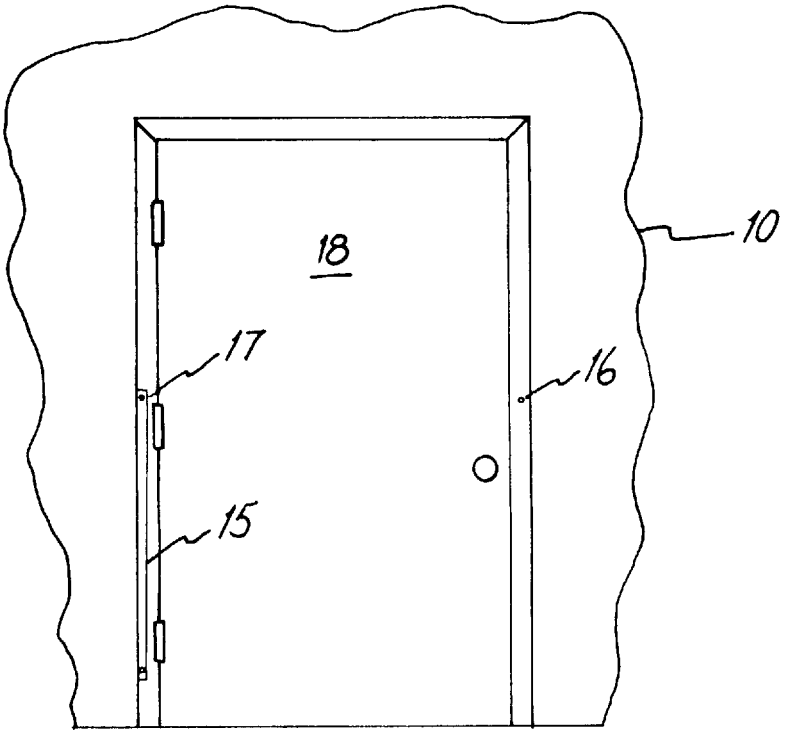
FIG. 2 shows the door and door bar of FIG. 1 in an out of the way position.

FIG. 2 shows the door bar 15 and door 18 of FIG. 1 with the door bar 15 located in an out of the way position that does not interfere with the opening and closing of the door 18. That is, door bar 15 is rotatable from a door securing position as shown in FIG. 1, to a free hanging condition where the door bar 15 does not interfere with the opening and closing of the door 18.

Figure 3:
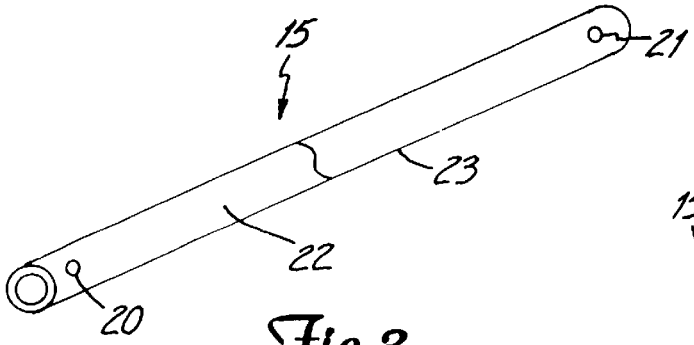
FIG. 3 shows a perspective of the door bar of the present invention.

FIG. 3 shows a perspective view of door bar 15 which is a rigid member comprising a cylindrical metal pipe having a first end with a diametrically extended opening 20 that extends through the end of door bar 15. Similarly, the other end of door bar 15 includes a second opening 21 that extends diametrically through the opening in the opposite end of door bar 15. Door bar 15 has an outer surface 23 which is shown partially covered with a decorative material 22 such as a decorative paper that can be selected to match the decor of the door or the door frame.

Figure 3A:
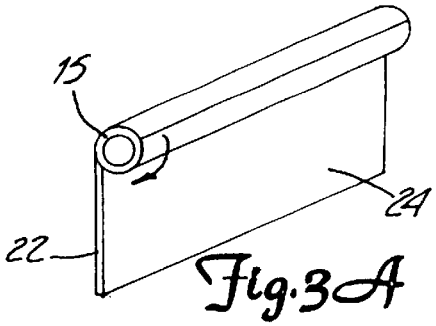
FIG. 3*a* shows the door bar with a decorative covering being applied thereto.

FIG. 3A shows that the decorative material 22 having an adhesive 24 can be wound around the door bar 15 to provide a decorative covering to door bar 15. That is, to apply the decorative material, one merely rolls decorative material 22 around door bar 15 until the door bar 15 is covered thus leaving a decorative exterior on the door bar 15.

Figure 4:
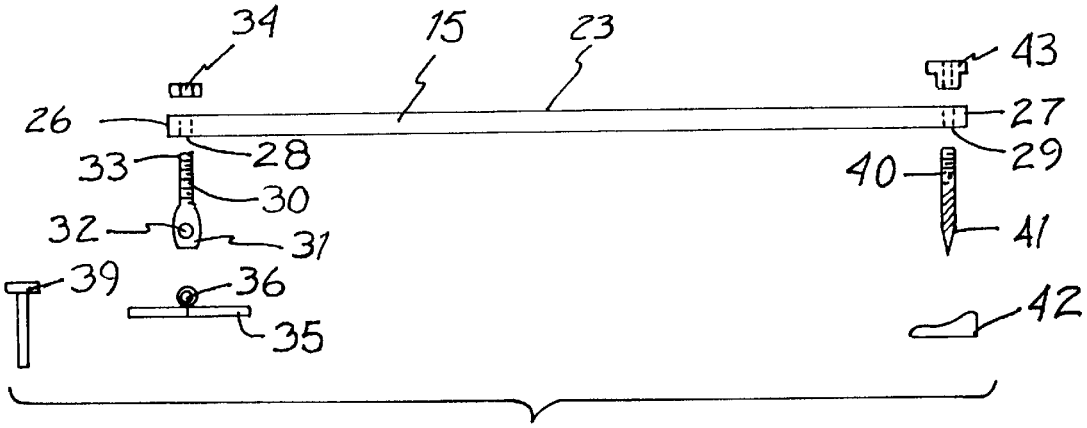
FIG. 4 shows an exploded view of the security kit proximate a hinge and a door frame.

FIG. 4 shows an exploded view of the door security kit comprising a door bar 15, a hinge pin attachment member 30, a first fastener 34, a second fastener 43 and a frame attachment member 40. Door bar 15 has an exterior surface 23, a first end 26 and a second end 27 with the door bar having sufficient length so as to extend beyond the width of a door to enable the door bar 15 to be secured on opposite sides of said door. The door bar 15 includes a first hole 28 extending diametrically through one end of rigid member 15 and a second hole 29 extending diametrically through the opposite end of rigid member 23.

Located adjacent from first hole 28 is the hinge pin attachment member 30 having a first end 31 with an eye 32 for securing to a hinge pin on a door frame, and a second end 33 having threads thereon for extending through the hole 28 in door bar 15. Located on top of door bar 15 is a first fastener 34 having an internal thread for securing to threaded end 33 of the hinge pin attachment member 30. First fastener 34 secures door bar 15 in a rotatable condition between hinge pin attachment member 30 and first fastener 34. That is, first fastener 34 loosely sandwiches door bar 15 between first fastener 34 and first end 31 to permit rotation of door bar 15 on hinge pin attachment member 30. A hinge 35, which has one portion fastened to the door frame and another portion fastened to the door, includes hinge knuckles 36 in alignment for receiving hinge pin 39. That is, with knuckles 36 positioned as shown, the hinge pin 39 can be inserted through eye 32 and into the knuckles 36 to hold the hinge pin attachment member 30 and door bar 15 thereto.

Located on the opposite end of door bar 15 is a frame attachment member 40 having a first end 41 with a tapered thread for securing to a door frame and a second end 40 with a male thread for extending through the second hole 27 in door bar 15 sufficiently far so as to form a securable end for engagement with a second threaded fastener 43. Second fastener 43 has an internal female thread for temporarily securing to the male thread on securable end 40 to hold the door bar 15 on the frame attachment member 40 so that when the hinge pin attachment member 30 and the frame attachment member are secured thereto as shown in FIG. I the door bar 15 prevents the door from being opened.

Figure 5:
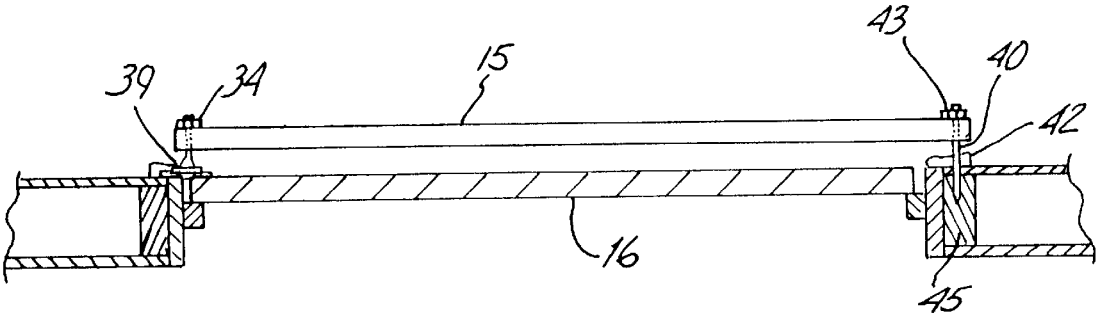
FIG. 5 shows a sectional view taken along lines 5—5 of FIG. 1.

FIG. 5 shows a top view partially in cross section of the door security kit mounted to a building. Hinge pin 39 holds hinge attachment member 30 to the hinge, while fastener 34 holds one end of door bar 15 to frame attachment member 30. The other end of door bar 15 is temporarily secured to frame attachment member 40 by threaded fastener 43 that can be removed to allow door bar to be pivoted away from frame attachment member 40. In the embodiment shown, the frame attachment member 40 is extended into the stud member 45 located in the wall in order to provide sufficient holding strength.

Thus, a feature of the invention is that the hinge attachment member 30 holds door bar 15 in a pivotal relationship along two mutually perpendicular axes. That is, door bar 15 can pivot around hinge attachment member 30 and hinge attachment member 30 can pivot about hinge pin 39, thus providing the freedom to both position and attach door bar 15.

I claim:

1. A security kit for attachment to a door frame comprising:

a rigid member, said rigid member having an exterior surface and a first end and a second end with said rigid member having sufficient length so as to extend beyond the width of a door to enable the rigid member to be secured on opposite sides of said door, said rigid member having a first hole extending through one end of said rigid member and a second hole extending through the opposite end of said rigid member;

a hinge pin attachment member having a first end for securing to a hinge pin on a door frame, said hinge pin attachment member having a second end for extending through the first hole in said rigid member;

a first fastener for securing to the second end of the hinge pin attachment member to hold said rigid member in a rotatable condition on said hinge pin attachment member;

a frame attachment member having a first end for securing to a door frame and a second end for extending through the second hole in said rigid member sufficiently far so as to form a securable end thereon; and a second fastener for securing to said securable end to hold said rigid member on said frame attachment member so that when the hinge pin attachment member and the frame attachment member are secured, the rigid member prevents the door from being opened.

2. The security kit of claim 1 including a roll of adhesive covered decorative paper for securing to said surface of said rigid member to provide a finished look to said rigid member.

3. The security kit of claim 2 wherein said first fastening member includes a female threaded section.

4. The security kit of claim 3 wherein said hinge pin attachment member includes a male threaded section for engagement with said female thread section of said first fastening member.

5. The security kit of claim 4 wherein said second fastening member includes a female threaded section.

6. The security kit of claim 5 wherein said frame attachment member includes a male threaded section for engagement with said female thread section of said second fastening member to enable quick and secure attachment thereto.

7. The security kit of claim 6 wherein said rigid member is a pipe.

8. The security kit of claim 7 wherein said hinge attachment member includes an opening therein for extending a hinge pin therethrough to hold said hinge attachment member thereto.

9. The security kit of claim 8 wherein said frame attachment member includes a lag screw on one end for securing to a wall stud.

10. The security kit of claim 9 wherein all the members are constructed from metal.

11. The security kit of claim 1 wherein said rigid member is pivotally mounted to said hinge attachment member so that said rigid member hangs down in an out of the way position when not in use.

12. A security kit for attachment to a door frame and addressing the esthetic concerns of a person comprising:

a door bar comprising a rigid metal member, said rigid metal member having an exterior surface and a first end and a second end with said rigid metal member having sufficient length so as to extend beyond the width of a door to enable the rigid metal member to be secured on opposite sides of said door, said rigid metal member having a first hole extending diametrically through one end of said rigid metal member and a second hole extending diametrically through the opposite end of said rigid metal member;

a decorative material for securing to the exterior surface to provide a visual decorative appearance to said rigid metal member;

a hinge pin attachment member having a first end with an eye for securing to a hinge pin on a door hinge, said hinge pin attachment member having a second end for extending through the first hole in said rigid metal member to hold said door bar in pivotal condition in mutually perpendicular axes;

a first fastener for securing to the second end of the hinge pin attachment member to hold said rigid metal member in a rotatable condition on said hinge pin attachment member;

a frame attachment member having a first end for securing to a door frame and a second end for extending through the second hole in said rigid metal member sufficiently far so as to form a securable end thereon; and a second fastener, said second fastener having threads for temporarily securing to said securable end to hold said rigid metal member on said frame attachment member so that when the hinge pin attachment member and the frame attachment member are secured, the rigid metal member prevents the door from being opened.

* * * * *